United States Patent [19]

Boeder et al.

[11] 4,242,960

[45] Jan. 6, 1981

[54] AUTOMATICALLY DISINTEGRATING MISSILE

[75] Inventors: Dieter Boeder; Christian Jaeneke, both of Duesseldorf; Rudolf Romer, Kaarst; Guenter Sikorski, Duesseldorf, all of Fed. Rep. of Germany

[73] Assignee: Rheinmetall GmbH, Duesseldorf, Fed. Rep. of Germany

[21] Appl. No.: 970,182

[22] Filed: Dec. 18, 1978

[30] Foreign Application Priority Data

Dec. 17, 1977 [DE] Fed. Rep. of Germany ..... 2756420

[51] Int. Cl.[3] ..... F42B 13/20; F42B 13/18

[52] U.S. Cl. ..... 102/92.7; 102/49.5; 102/91; 102/93

[58] Field of Search ..... 102/92.7, 91, 49.5, 102/93

[56] References Cited

U.S. PATENT DOCUMENTS

| | | | |
|---|---|---|---|
| 3,080,817 | 3/1963 | Robinson et al. | 102/92.5 |
| 4,140,061 | 2/1979 | Campoli | 102/92.7 |

*Primary Examiner*—Benjamin R. Padgett
*Assistant Examiner*—Irwin Gluck

[57] ABSTRACT

There is disclosed a missile which automatically disintegrates after a predetermined flight time. The missile is made up of several parts which are positively secured together by a locking means which is released at a predetermined time after the firing of the missile by the action of the air through which the missile passes during its flight. The invention may by used to advantage in both practice missiles and service missiles.

15 Claims, 6 Drawing Figures

AUTOMATICALLY DISINTEGRATING MISSILE

BACKGROUND OF THE INVENTION

The present invention relates to a missile which automatically disintegrates after a predetermined flight time. The invention may be used to advantage in both practice missiles and service missiles.

Missiles of this type have been hitherto used in anti-aircraft guns, in order to initiate ignition of an explosive missile after a certain flight time, if impact detonation has not occurred until then. For this purpose, a spontaneous disintegration device is required, which, since there is no impact-impulse in the case of spontaneous disintegration, effects the piercing of an explosive capsule at the desired time by a pressure-loaded spring which is incorporated in the fuse under prestress as an energy reservoir.

A spontaneous disintegration device of this type is described in the Rheinmetall "Handbook of Armament Technology" ("Waffentechnisches Handbuch"), pages 574/575—1977 Edition.

A condition for the spontaneous disintegration device mentioned being able to become effective is that a suitable explosive charge is present in the missile. It follows from this that a spontaneous disintegration device of this type is of no use in missiles which do not usually contain any explosive charge, such as, for example, purely kinetic energy (non-explosive) missiles or practice missiles.

It is conceivable to provide a small disintegration charge and a corresponding spontaneous disintegration device, for example, for sub-caliber wing-stabilized arrow-missiles or for practice missiles, but, in this way, the missile becomes considerably more complex, especially as arrow-missiles are discharged without spin; the above-mentioned spontaneous disintegration device is useless in missiles discharged without spin and is therefore to be replaced by a purely time-controlled spontaneous disintegration device.

SUMMARY OF THE INVENTION

The object of the present invention is to create a missile or projectile of the above-mentioned type which, therefore avoids the shortcomings of the known missiles with spontaneous disintegration devices, is of simple construction, does not require any explosive charge, and can be employed. The missile or projectile of the invention regardless of whether the missile is discharged with our without spin. In this connection, the missile is preferably made as a missile with flat trajectory and, if it is developed as a practice missile, makes it possible to bombard targets located at a normal combat distance under the same conditions as is the case with service missiles. The missile of the invention, however, disintegrates spontaneously after a short time if the target is missed, so that practice shooting can be carried out on practice-grounds of limited expanse. Ideally, this type of missile is no more expensive to produce than a service missile of the same type; practice missiles in accordance with the invention are economical and easy to produce.

The missile of the invention is made up of a plurality of parts which are positively secured together by a locking means which is released at a predetermined time after the firing of the missile by the action of the air through which the missile passes during its flight. In certain of the disclosed embodiments of the missile of the invention the parts thereof are secured together by metal or plastic material which melts as the exterior wall of the rapidly travelling missile is heated by the friction between the missile and the air through which the missile passes in its flight.

In another disclosed embodiment of the missile of the invention, a piston in a cylinder is disposed in the missile, said cylinder being in communication with a conduit leading to the tip of the missile. Rearward movement of the piston by the pressure of air at the missile tip is opposed by viscous material contained in the cylinder rearwardly of the piston, such material escaping through an orifice of small cross section. The rearward movement of the piston fractures lugs which hold the separate, sector-shaped parts of the missile body together, thereby allowing the missile to disintegrate.

Since the effect of the air flowing around the missile is used for releasing locking-elements after a time delay, no spontaneous disintegration device of known type which requires an explosive charge for disintegration has to be provided. The missile according to the invention is extremely safe operationally, and is devoid of any parts which can continue flying at considerable velocity despite the disintegration of the missile, since the missile parts, after disintegration have an unstable flying behavior and are very rapidly decelerated.

BRIEF DESCRIPTION OF THE DRAWING

Further features and advantages of the invention will become clear from the following description and drawings In the drawings, which illustrate several embodiments of the invention.

DETAILED DESCRIPTION

Figure 1:
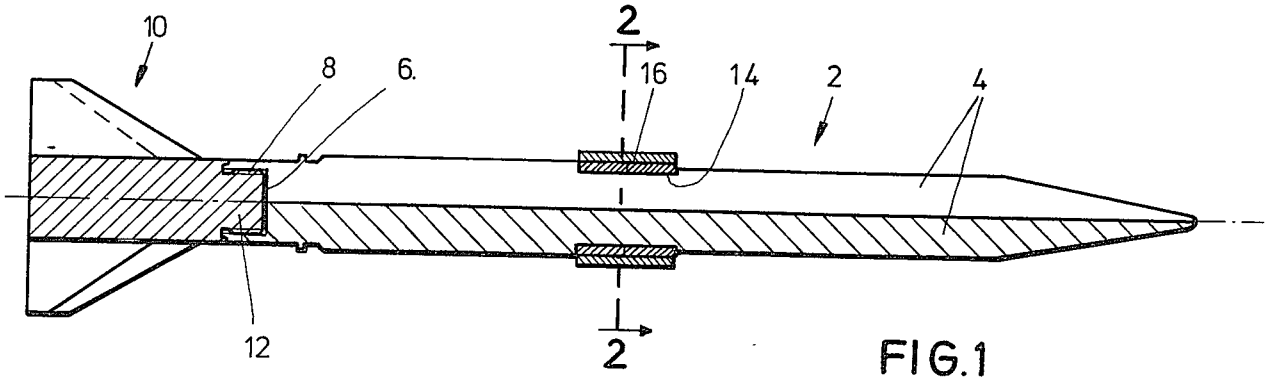
FIG. 1 is a view partially in side elevation and partially in longitudinal axial section of a first embodiment of automatically disintegrating missile in accordance with the invention.
Figure 2:
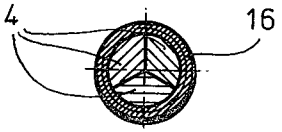
FIG. 2 is a view in transverse section through the missile of FIG. 1, the section being taken along the line 2—2 in FIG. 1.
Figure 3:
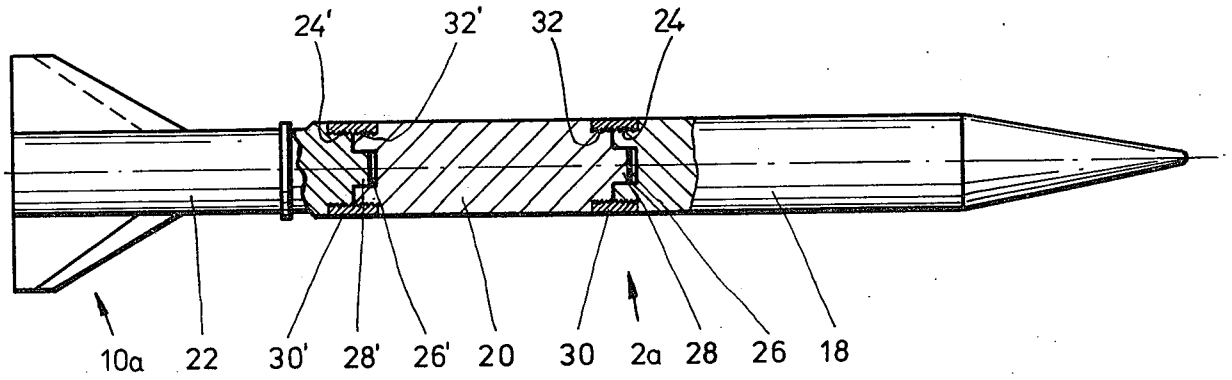
FIG. 3 is a view partially in side elevation and partially in longitudinal axial section through a second embodiment of automatically disintegrating missile in accordance with the invention, such missile being capable of use as a kinetic energy missile.
Figure 4:
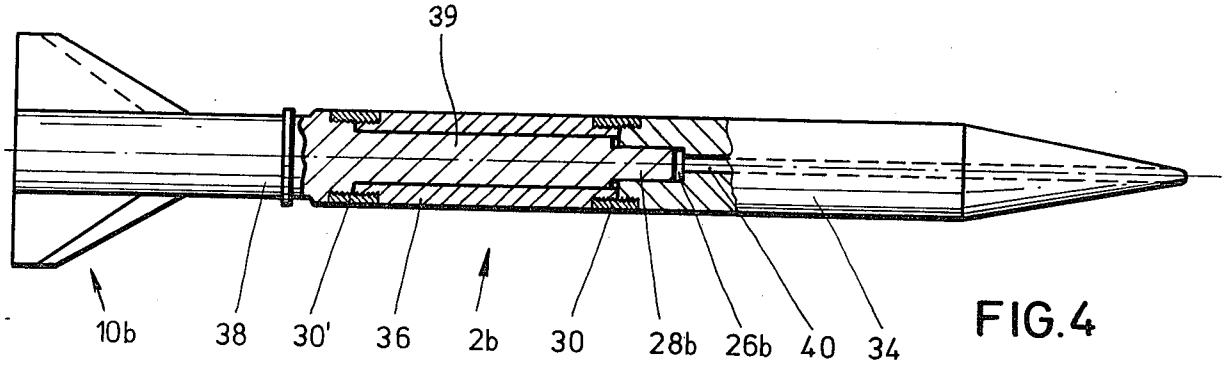
FIG. 4 is a view partially in side elevation and partially in longitudinal axial section of a third embodiment of the missile of the invention, such missile also being useful as a kinetic energy missile.
Figure 5:
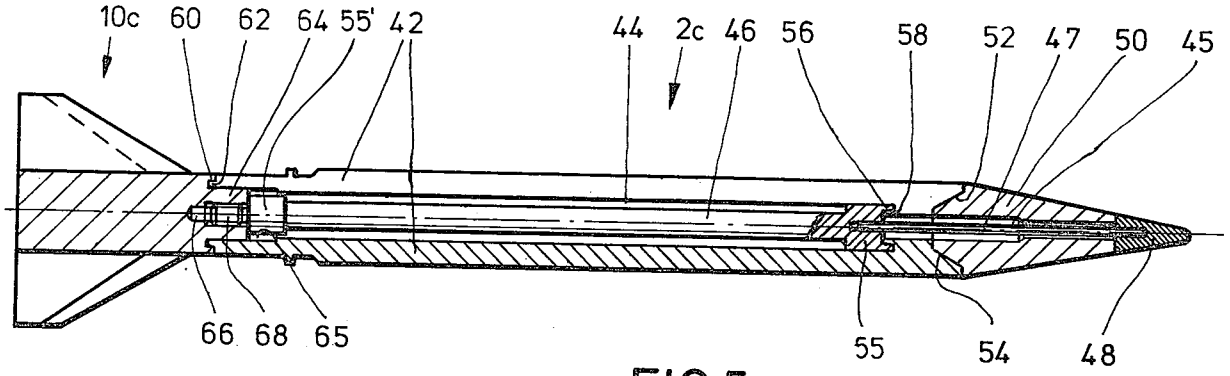
FIG. 5 is a view in longitudinal axial section of a fourth embodiment of the missile of the invention, such missile being useful as an automatically disintegrating practice missile.
Figure 6:
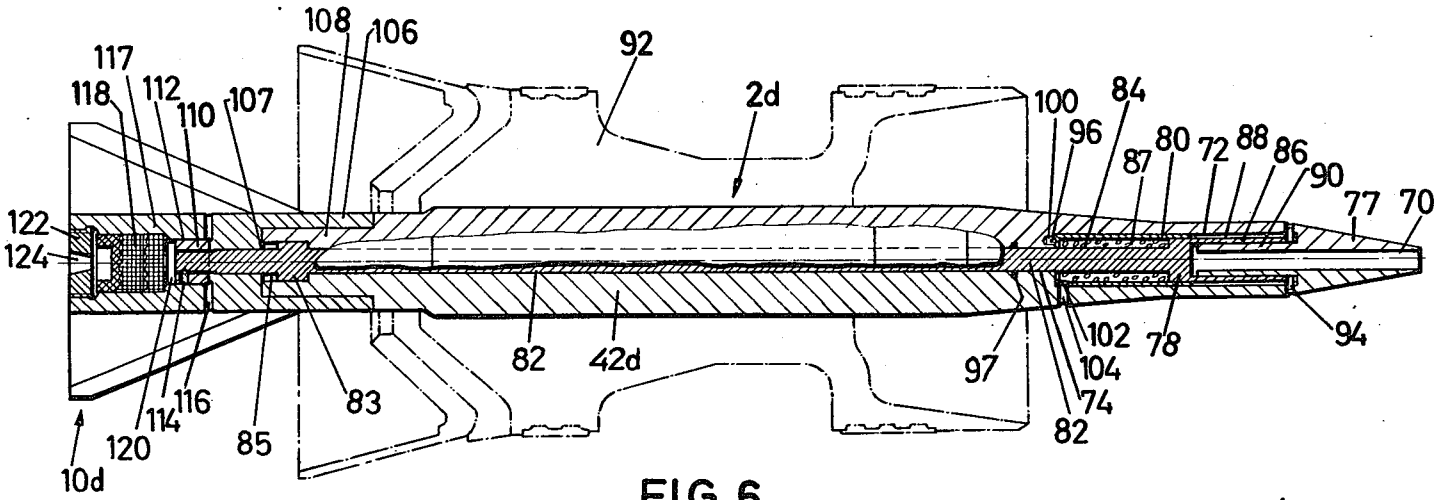
FIG. 6 is a view in longitudinal axial section of a fifth embodiment of automatically disintegrating missile in accordance with the invention, such missile being adapted for practice use, the missile being illustrated as mounted in a drive cage or sabot therefor which is shown in phantom lines.

As is apparent from the above, five embodiments of automatically disintegrating missiles are shown, the first such embodiment being shown in FIGS. 1 and 2, the second embodiment being shown in FIG. 3, the third embodiment being shown in FIG. 4, the fourth embodiment being shown in FIG. 5, and the fifth embodiment being shown in FIG. 6.

Turning first to FIGS. 1 and 2, the missile there shown is made up of a missile body 2 and a wing tail unit 10 mounted on the rear of the body 2. The missile body 2 is formed of three identical parts 4 which is sector-shaped in transverse section as shown in FIG. 2. At its rear end the missile body 2 is provided with a shallow axial bore 6 which receives therewithin an axially forwardly extending central pin or stub 12 on the wing tail unit 10. The bore 6 and the pin 12 have mutually engaging formations 8 thereon which may be, for example, threads or, alternatively, axially spaced annular grooves on the one member and lands on the other member received within said grooves.

Each of the missile body parts 4 has a part-annular groove therein, such part-annular grooves together forming a complete annular groove in the missile body 2 when the parts 4 thereof are assembled as shown. A sleeve 16 received within the annular groove 14 locks the missile body parts 4 together to form the body 2 to which the wing tail element 10 is secured in the manner above-described.

Sleeve 16 may be made, for example, of a low melting point metal or of a plastic material, the sleeve 16 being applied to the body 2 after it has been assembled from the parts 4 by being rolled, cast, or injection molded into the annular groove 14, the manner of application of the sleeve 16 to the body 2 depending upon the composition of the sleeve. If the mutually engaging formations which secure the wing tail unit 10 to the body 2 consists of threads, the wing tail unit 10 can be screwed onto the body 2 after the parts 4 thereof have been assembled. If, however, the interfitting formations 8 are made up of circular grooves and lands, the wing tail unit 10 is assembled with the body of the missile at the same time that the body parts 4 are put together to form such body.

The type of missile shown in FIGS. 1 and 2 has a high discharge velocity. The low melting point metal or plastic material of which the sleeve 16 is made softens or melts during the flight of the missile, by reason of the rise in temperature of the external surface of the missile caused by the frictional effect upon the missile of the air through which it travels.

The flight distance up to the complete melting away of the sleeve 16 can be determined by the suitable choice of the material of which the sleeve is made, of the thickness of the sleeve, and of the conditions of heat transfer between the missile body 2 and the sleeve 16. The sleeve 16 may be made up of one or more layers of material. Two layers are shown in FIGS. 1 and 2, such layers being formed by rolling or winding a band or tape of material into the groove 14. After the sleeve 16 has softened sufficiently or melted away, the missile body 2 disintegrates, predominantly under the influence of the heating effect upon the missile body by air friction, into structurally predeterminable individual parts the flight behavior of which is unstable so that their further trajectory is considerably shorter than that which the missile would have had if it had remained integral or in undisintegrated condition.

The second illustrated embodiment of the missile, shown in FIG. 3, has a body 2*a* to the rear of which there is secured a wing tail unit 10*a*. The body 2*a* is made up of a tip 18, an intermediate or center part 20, and a tail part 22 of which the wing tail unit 10*a* is a part. The rear end of the tip 18 is provided with a shallow central axially extending bore 26 in which a central axially forwardly extending pin 28 on the intermediate portion 20 is accurately received. The rear end of central portion 20 is provided with a central axially extending shallow bore 26′ which accurately receives a central axially forwardly extending pin 28 on the forward end of the tail part 22.

Parts 18, 20 and 22 of the missile are secured together by bands 30 and 30′ made of low melting point metal or plastic material as is described in connection with the embodiment of FIGS. 1 and 2, band 30 being received in an annular groove 24 formed partially in tip 18 and partially in central part 20 of the missile body the root of groove 24 and the radially inner surface of the band 30 having interfitting formations 32 which may be in the form of interfitting annular bands and grooves or, alternatively, mating threads. The central part 20 and the tail part 22 of the missile are similarly secured together, there being an annular groove 24′ formed partially in the rear end of the part 20 and partially in the forward end of the part 22, a sleeve 30′ being disposed in groove 24′ and secured to the respective parts 20 and 22 by interfitting formations 32′ which may be similar to those at 32.

As in the case of the missile of FIGS. 1 and 2, the missile of FIG. 3 travels at high speed through the air. The rise in temperature of the outer surface of the missile of FIG. 3 thus causes the sleeves 30 and 30′ partially or completely to melt during the flight of the missile through the air, so that after a predetermined flight distance the parts 18, 20 and 22 separate. The flight behavior of such separate parts is unstable and their further trajectory is considerably shorter than would have been the trajectory of the integral, undisintegrated missile.

The third embodiment of missile in accordance with the invention, shown in FIG. 4, is made up of the tip 34, a tubular center or intermediate part 36, and a tail part 38 which includes a wing tail unit 10*b*. The center part of the body 2*b* of the missile is made up of both the tubular part 36 and an elongated central axially forwardly projecting rod or shaft 39 integrally connected to the tail part 38 and fitting within the tubular part 36. The forward end of part 39 has a central, axially forwardly projecting pin 28*b* which fits within a central bore 26*b* in the rear end of the tip 34.

The tip 34 and the tubular part 36 are connected by a band or sleeve 30 made of low melting point metal or plastic material. The tubular part 36 and the tail part 38 are connected together by a sleeve or band 30′ made of low melting point metal or plastic material. Such connections are the same as those similarly designated in FIG. 3.

In the embodiment in accordance with FIG. 3, disintegration of the missile takes place as a result of the fact that the tail part 22 with the wing tail unit 10 possesses a higher air resistance than the forward parts 18 and 20, so that the tail part 22 is detached from the center part 20 and the tip 18. The center part 20 subsequently separates from the tip 18. In the embodiment of FIG. 4 there is provided an additional aid for the detachment of the tail part 38 from the other parts of the missile. Thus there is provided a central axially extending passage 40 which extends through the tip 34 from the forward end thereof into communication with the bore 26*b*. As the missile flies through the air atmospheric air under pressure enters the bottom of the bore 26*b* through the passage 40, thus acting upon the pin 28*b* to expel it from the bore 26*b*.

In the fourth embodiment of the missile of the invention, shown in FIG. 5, the meltable element which secures the parts of the missile together is in the form of the forward end 48 of the missile tip 50. The missile there shown has a missile body 2*c*, the central zone of which is subdivided in a longitudinal direction into three identical missile body parts 42 which are sector-shaped in cross-section and which interfit to form the missile body in the same manner as the parts 4 in the embodiment of FIGS. 1 and 2. The interfitting body parts 42 are provided with a central axially extending bore 44 therethrough, bore 44 continuing into a smaller diametered axially extending bore 45 in the missile tip 50. The rear end of the missile tip 50 is in the form of a frustum 52 of a cone, the axis of which concides with the axis of the missile body 2*c*. Formation 52 is matingly received within a frusto-conical recess 54 on the forward end of the part of the missile body formed by the interfitting parts 42. A central axially extending rod 46 having a diameter somewhat smaller than that of the bore 44 extends longitudinally within such bore, the forward end of rod 46 terminating in an enlarged head 55 of appreciable axial length fitting accurately within the bore 44. The forward end of head 55 is provided with a forwardly projecting annular flange which is received within an annular recess in the part 42 of the missile body and overlaps the rearwardly projecting annular flange 58 which defines the radially inner wall of such recess. A rod 47 extends centrally longitudinally through the bore 45 in the missile tip, rod 47 being secured at its forward end to the destructable securing element 48 in a suitable manner, the rear end of rod 47 being screwed into the head 55 on rod 46.

The wing tail unit 10*c* is provided with an axially forwardly projecting flange 60 which overlaps a rearwardly projecting annular flange 62 on the rear ends of the missile body parts 42. The rod 46 is provided adjacent its rear end with an enlarged head 55' which accurately fits within the rear end of the bore 44, there being a rearwardly projecting central threaded pin 68 on head 55', such pin being threaded into a bore 66 in the forward end of the central portion of the wing tail unit 10*c*. As shown, the rear end portion of the head 55' on rod 46 is received within an annular recess 65 at the rear end of the missile body 2*c*.

The missile is assembled by sliding the missile body parts 42 along the rod 46 which has been previously screwed into the central bore 66. After this, the missile tip 50 is placed in position, and the securing element 48, connected to the rod 47, is screwed into the head 55 on the front end of the rod 46, the rod 46 itself being screwed into the load 55. The missile thus assembled is completely safe to handle and resists all loads arising from its handling or being fired. As soon as the securing element 48 has melted away after a certain flying time of the missile, however, the rod 47, the rod 46, and the wing tail unit 10*c* shift rearwardly with respect to the missile tip 50 and the missile body 2*c*, as has been explained with the embodiment of FIG. 3, so that the missile body parts 42 become radially detached and thus initiate the disintegration of the entire missile. It is to be understood that the securing element 48 may be made of low melting point metal or plastic material, as are the securing sleeves of the previously described embodiments.

The fifth illustrated embodiment of the missile of the invention shown in FIG. 6, is constructed in principle in a manner which is similar to that of the missile shown in FIG. 5. The missile body 2*d* is divided into three identical missile body parts 42*d* which are sector-shaped in cross-section and which include a tip 77. In this embodiment, however, it is not the rise in temperature of the missile or a part thereof during flight that is utilized for causing a securing element to melt. Instead, the dynamic pressure of the air encountered by the missile during its flight, acting on the missile tip 77, is passed by way of a bore 70 in the missile tip to a securing element in the form of a piston 78. Piston 78 is slidably guided within a cylinder 80 and is sealed with respect thereto, the piston being connected to a piston rod 82 which extends longitudinally within a central axial bore in the missile body 2*d* to the rear end of the missile where it is affixed to the wing tail unit 10*d*. The cylinder 80 is disposed in a bore 72 in the missile body 2*d*. The piston rod 82 is guided in a bore 74 in the central zone of the missile body 2*d*. The annular space 84, formed between the piston rod 82 and the rear end of the cylinder 80 is filled with a viscous medium which can escape from the cylinder by way of a passage 102 through the wall of the cylinder 80 at the rear thereof and a communicating bore 104 in the missile body part 42*d* when such viscous material is placed under pressure by the rearward travel of the piston 78.

The viscous mass 87 may may consist of wax, or for example, of micro-encapsulated liquids of relatively high viscosity or, alternatively, of another liquid or preselected viscosity, the viscous material 87 being of such character that, taking into account the diameter of the piston 78, the transverse area of the annular space between the piston rod 82 and the inner wall of the cylinder 80, and the cross-sectional area of the escape path 102, 104 for the viscous material from such annular space, a damping of the rearward shifting of the piston 78 is obtained. The damping of the piston 78 is of such magnitude that the entire rearward travel of the piston up to the release of the missile body parts 42*d* takes place in a predetermined time which corresponds to the desired flight time of the missile. In accordance with another, undisclosed, embodiment, the viscous mass 87 may be in the form of a tearable plastic tube inflated with viscous material, such tube being spirally wound into the annular space 84.

In order that the bores 102 and 104 shall always be positioned in alignment, the cylinder 80 is secured against rotation about its axis. For this purpose there is provided an axially extending recess 100 in a missile part 42*d*, an axially extending lug 96 on the rear end of the cylinder 80 being accurately received within such recess. Projecting forwardly from the piston 78 there is a tube-like sleeve or collar 86 coaxial therewith which is telescoped over a rearwardly projecting tubular extension 90 of the missile tip 77. In the position shown in FIG. 6, the piston 78 is secured against rearward movement with respect to the body of the missile by radially extending shearable studs 94 which are secured in radial openings in the missile tip 77 and in the forward end of the member 86. Studs 94 are designed to shear when subjected to a predetermined shearing force. Studs 94 may be optionally dispensed with, if the resistance of the tearable plastic tube containing the viscous mass in the above-disclosed optional construction is high enough for preventing the rearward shift of the piston 78 so long as the load on the piston stays below a predetermined value.

There is an annular space 88 between the axially projecting sleeve 86 and the interior zone of the missile body parts 42*d*, the diameter of which corresponds to the diameter of the cylinder 80. This annular space remains free, so as to make assembly of the missile body parts 42*d* possible. With the wing-stabilized subcaliber missile in the embodiment shown, transfer of the pressure of the propelling charge to the missile is effected by means of a drive-cage 92, which is shown in phantom lines and is disclosed, for example, in U.S. Pat. No. 3,620,167. A ring 97 engages in a corresponding groove of the missile body parts 42*d* and thereby prevents axial shifting of the missile body parts 42*d* with respect to one another.

The wing tail unit 10*d* possesses a tail unit carrier 117, the front end of which is provided with an axially projecting sleeve 106, which is telescoped over a rearwardly projecting portion 108 of the parts 42*d* of the missile body 2*d*. An enlarged head 83 on the rod 82 is located in a recess 85 at the rear end of the portion 108 and eventually engages an internal end surface 107 within the axially projecting sleeve 106 during a shifting of the rod 82 relative to the missile body 2 and the wing tail unit carrier 117 towards the back upon discharge acceleration. A threaded sleeve 110 is located in a recess 112 of the wing tail unit carrier 117 and the rod 82 is screwed into it. The rod 82 is secured against rotation by a radial stud 114. Radial passages 116 are provided to create pressure compensation for the combustion pressure of a fuel composition 118, acting on the threaded sleeve 110, in a recess 120. The fuel composition 118, located in the recess 120 at the rear end of the wing tail unit carrier 117, can take the form, for example, of a rocket propelling composition for the after-acceleration of the missile after leaving the barrel of the weapon, an aperture 124 being formed in a cover disc 122 to function as a nozzle for this purpose, or, alternatively, fuel composition 118 may serve to generate a tracer trajectory, the base drag of the missile being compensated for, more or less, by the issuing fuel gases, which contributes to reduction of the resistance.

The mode of action of the missile shown in FIG. 6 is as follows:

After the discharge of the missile, the gas pressure in the gun-barrel rises. The wing tail unit carrier 117 is pressed against the missile body since the acceleration of the wing tail unit carrier 117, at first, is still greater, on account of the force of the gas, than the acceleration of the missile body 2*d* via the drive-cage 92 and the rod 82, through the force of the gas.

After a certain gas pressure has been attained, the sum of the acceleration force and of the force of the gas on the rod 82 becomes so great that the radial studs 94 shear off and the rod 82, together with the piston 78, which is damped by the viscous mass in the annular space 84, moves backwards relative to the remaining missile parts. As soon as the collar 86 and the sleeve 106 have released the corresponding extensions 90, respectively 108, the parts 42*d* can fly apart. For this purpose the head 83 comes into contact with the interior end surface 107. Thus a slight backward shift of the piston 78 relative to the missile body 2*d* takes place shortly after discharge. After the missile has left the gun barrel the only remaining action on the piston 78 comes, on the one hand, from the dynamic pressure at the missile tip by way of the passage 70 and, on the other, from the air resistance of the wing tail unit 10*d* and the base drag at the missile tail, so that the piston 78 moves backwards in the cylinder 80. This backward movement is retarded or damped by the viscous medium, located in the annular space 84, which escapes to the outside by way of the passages 102 and 104. As soon as the sleeve 86 and the sleeve 106 release the corresponding parts 90 and 108, respectively, the missile body parts 42*d* can radially move apart and the missile disintegrates. Since the missile body parts 42*d* and the wing tail unit 10*d*, on its own, have an unstable flight behavior, the individual missile parts fall to to ground after a very short additional flight path.

The time of flight before the missile disintegrates can be adjusted by various determining parameters. The nature of the viscous medium in the annular space 84 can be suitably chosen. Moreover, the cross-sectional area of the annular space 84 is of importance, as well as the cross-sectional aread of the passages 102 and 104. A further determining factor is the presence or absence of a thrust-generating fuel composition in the wing tail unit 10*d*; the backward movement of the piston 78 in the cylinder 80 is more or less retarded according to the magnitude and duration of the thrust generated.

It is thus possible to influence the flight-behavior of the missile in a simple manner, so that any desired flight-time or range up to disintegration can be attained.

As has already been mentioned at the beginning, the present invention is not limited to practice missiles, but is also applicable to service missiles. Further, a missile with an automatic disintegration effect according to the invention need not be wing-stabilized, but can be spin-stabilized; nor need the missile be made as a sub-caliber missile, but it can be a large or full-caliber missile.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A missile having a tip and a tail end, which automatically disintegrates after attaining a predetermined flight time, comprising a missile body formed of at least two parts, a sleeve coaxially mounted with respect to the missile on said two parts thereby gripping said parts and holding them together, said sleeve being formed of a material which softens or melts as a result of the increase of temperature caused by the air flowing around the missile during its flight, at least two parts being formed as identical sector-shaped parts in a longitudinal direction, such parts of the missile body forming a recess at the tail end of the missile, wing tail unit having a stud received and held within the recess, and an annular groove encircling the missile body in a central zone thereof, the sleeve for securing the missile body parts together being disposed in said annular groove.

2. A missile according to claim 1, wherein the missile body is divided at right angles to its longitudinal axis, the missile body parts are formed so as to be capable of being interlocked in a longitudinal direction, and the sleeve and the missile body parts are provided with projections mutually engaging in a radial direction, such projections preventing any shifting of the parts of the missile body in an axial direction.

3. A missile according to claim 1, wherein the missile has a forwardly open passage extending longitudinally of the forward end thereof and intercommunicating with a transverse surface of the next rearwardly located part of the missile body, whereby the dynamic pressure of air through which the missile travels in flight aids in the separation of the tip and next rearwardly located part of the missile body from each other upon the softening or melting of the looking means.

4. A missile according to claim 1, wherein the missile has a wing tail unit carrier, and comprising a thrust-generating fuel composition located in the wing tail unit carrier, such composition compensating at least partially for the air pressure to which the missile is subjected during a part of its flight time.

5. A missile having a tip and wing tail unit end which automatically disintegrates after attaining a predetermined of flight time, comprising a missile body formed of a plurality of parts, a locking means including a part which forms at least part of the tip of the missile and being coaxial therewith, said tip part being at least partially formed of a material which softens or melts as a result of the increase of temperature caused by the air flowing around the missile during its flight, an axial passage extending through the missile body from adjacent the forward end thereof to the wing tail unit thereon, a rod slidably mounted within said axial passage through the missile body, the rear end of the said rod being secured to the wing tail unit, said rod forming another part of said locking means and locking said parts of said missile together when said rod is in a forward locked position and releasing said parts of said missile when said rod has been shifted rearwardly by the air flowing around said missile during flight after said tip part has molten or softened sufficiently.

6. A missile which automatically disintegrates after attaining a predetermined flight time, comprising a missile body formed of a plurality of parts, a locking means for positively locking said missile body parts to one another, the locking means being mounted on the missile body and being releasable after a predetermined time delay by the action of the air flowing around the missile in its flight, the locking means includes a securing element which can be shifted by the air flowing around the missile during its flight, the missile body is divided into at least two longitudinally extending identical sector-shaped parts, and the securing element comprises a piston displaceable longitudinally of the missile body and located in one of the parts of the missile body, said piston being capable of being displaced rearwardly of the missile body by the pressure of the air through which the missile travels and by the force of inertia upon the piston after the discharge of the missile.

7. A missile according to claim 6, wherein the missile body comprises a cylindrical component part which is divided into three longitudinally extending sector-shaped parts, means interlocking the missile tip with the cylindrical component part in a longitudinal direction, the cylindrical component part has the wing tail unit at the rear end thereof, means for axially interlocking the wing tail unit with the rear end of the cylindrical component part of the missile body, the rod within the central passage through the missile body having formations adjacent the rear end thereof and adjacent the tip of the missile, said formations projecting in an axial direction and having a telescopic relationship with mating formations respectively on the wing tail unit and the tip of the missile, said mating telescoping formations locking the respective parts of the missile together when the rod is in its forward position with respect to the missile body.

8. A missile according to claim 6, comprising means for damping the motion of the piston in a direction rearwardly of the missile body, said damping means including a cylinder disposed longitudinally of the missile body, the piston being mounted for reciprocation in said cylinder, viscous damping material being disposed in the cylinder rearwardly of the piston, and at least one passage in the rear end of the cylinder to permit the escape of the viscous material therefrom upon the rearward travel of the piston relative to the missile body.

9. A missile according to claim 8, wherein the missile body has an axially extending bore therein, a rod disposed within said bore and reciprocable with respect thereto and means for locking the parts of the missile together, said locking means comprising means for securing the forward end of the rod to the tip of the missile and means at the tail end of the missile including telescoping parts one of which is secured to the rear end of the rod and to the wing tail unit and the other of which includes the rear end of the missile body, said latter securing means being disengaged upon the rearward movement of said rod.

10. A missile according to claim 9, wherein there is an axial bore extending from the forward end of the missile tip to the forward end of the cylinder in which the piston is mounted.

11. A missile accordidng to claim 10, wherein wing tail unit is mounted at the tail end of the missile body, said wing tail unit being capable of being axially interlocked with the missile body, the rod being connected to the wing tail unit, each of the wing tail unit and the piston is provided with an axially extending sleeve which overlaps a corresponding projection on the missile body at the tail and forward end thereof, respectively.

12. A missile according to claim 11, wherein the missile body is divided into three longitudinally extending identical sector-shaped parts, the missile body presenting a cylindrical space therein in the zone of the missile tip, a cylinder enclosing a piston reciprocable therein being disposed in said cylindrical space, the rear end of the cylinder communicating with the atmosphere through a passage in the missile body, a forwardly extending sleeve coaxial of the piston connected thereto and being connected to the missile body by means of at least one shear pin disposed essentially radially of the missile axis and having a predetermined rupture zone.

13. A missile according to claim 6, wherein the rod in the zone of the tail of the missile body has an enlarged head thereon, the rear face of such head being located at a distance from the interior forward surface of the wing tail unit carrier.

14. A missile according to claim 8, wherein the viscous damping means, which is disposed in the cylinder rearwardly of the piston therein, is enclosed in the package that can be torn open upon the application of pressure thereto.

15. A missile according to claim 14, wherein the package of the viscous damping material is in the form of a welded plastic tube which is disposed in the cylinder rearwardly of the piston and is wound around the piston rod.

* * * * *